United States Patent [19]

Kawamura et al.

[11] Patent Number: 4,882,252

[45] Date of Patent: Nov. 21, 1989

[54] ELECTROPHOTOGRAPHIC SENSITIVE MEMBER WITH AMORPHOUS SILICON CARBIDE

[75] Inventors: Takao Kawamura, 17-11, 1-cho, Takakuradai, Sakai-shi, Osaka-fu; Naooki Miyamoto, Yohkaichi; Hiroshi Ito, Yohkaichi; Hitoshi Takemura, Yohkaichi; Kazumasa Ohkawa, Yohkaichi; Kokichi Ishibitsu, Yohkaichi, all of Japan

[73] Assignees: Kyocera Corporation, Tokyo; Takao Kawamura, Sakai, both of Japan

[21] Appl. No.: 197,461

[22] Filed: May 23, 1988

[51] Int. Cl.[4] ..... G03G 5/082; G03G 5/14

[52] U.S. Cl. ..... 430/58; 430/65

[58] Field of Search ..... 430/57, 58, 65

[56] References Cited

U.S. PATENT DOCUMENTS

| | | | |
|---|---|---|---|
| 4,361,638 | 11/1982 | Higashi et al. | 430/84 X |
| 4,510,224 | 4/1985 | Yamazaki et al. | 430/57 |
| 4,536,460 | 8/1985 | Kanbe et al. | 430/57 |
| 4,579,798 | 4/1986 | Saitoh et al. | 430/57 |
| 4,673,629 | 6/1987 | Yamazaki et al. | 430/58 |

FOREIGN PATENT DOCUMENTS

| | | | |
|---|---|---|---|
| 63-29762 | 2/1988 | Japan | 430/58 |

*Primary Examiner*—Roland E. Martin

*Attorney, Agent, or Firm*—Spensley Horn Jubas & Lubitz

[57] ABSTRACT

The present invention relates to an electrophotographic sensitive member, in particular to an electophotographic sensitive member, in which a residual potential is reduced and a background smearing is prevented from being produced, and further to an electrophotographic sensitive member capable of carrying out a high-speed copying suitable for a semiconductor laser beam printer.

A photosensitive member used in instruments, such as super-high-speed coying machine and laser beam printer, is used for a long time at a high-speed, so that the stability and durability are required for the operation.

To this requirement, amorphous silicon hydride has been watched with interest in view of heat-resistance, abrasion-resistance, anti-pollution, photosensitive characteristic and the like.

However, also a multi-layer type photosensitive member or a separated function type photosensitive member, which has been known as an electrophotographic sensitive member formed of this amorphous silicon hydride, has shown a problem of residual image that the preceding image is not completely removed to be remained by an optical memory effect and appears again in the formation of the following image when it is used in the high-speed copying, a problem that the oscillation wavelength of laser beam is close to a near-infrared range, so that an amorphous silicon photosensitive member on the light-receiving side is inferior in photosensitive characteristic when the amorphous silicon photosensitive member is carried on the laser beam printer, and a problem that the surface potential is reduced.

The present invention aims at the obtainment of an electrophotographic sensitive member from which the above described problems are eliminated.

15 Claims, 4 Drawing Sheets

ELECTROPHOTOGRAPHIC SENSITIVE MEMBER WITH AMORPHOUS SILICON CARBIDE

DETAILED DESCRIPTION OF THE INVENTION

1. Field of the Invention

The present invention relates to an electrophotographic sensitive member, in which a residual potential is reduced and a background smearing is prevented from being produced and further to an electrophotographic sensitive member capable of carrying out a high-speed copying suitable for a semiconductor laser beam printer.

2. Prior Art and Problems thereof

Recently, an electrophotographic sensitive member has made a remarkable advance and the development of a superhigh-speed copying machine, laser beam printer and the like has been actively made progress. A photosensitive member used in these instruments is used for a long time at a high-speed, so that the stability and durability are required for the operation. To this requirement, amorphous silicon hydride has been watched with interest in view of superior heat-resistance, abrasion-resistance, anti-pollution, photosensitive characteristic and the like.

A multi-layer type photosensitive member as shown in FIG. 2 has been proposed for an electrophotographic sensitive member formed of such amorphous silicon (hereinafter referred to a-Si for short).

That is to say, referring now to FIG. 2, an a-Si carrier barrier layer (2*a*), an a-Si carrier generation layer (3*a*) and a surface protection layer (4*a*) are piled up in turn on an electrically conductive substrate (1*a*) formed of aluminum and the like, said carrier barrier layer (2*a*) being formed in order to prevent the carrier from said substrate (1*a*) from being poured and heighten the surface potential, and said surface protection layer (4*a*) being formed of materials having a high hardness to heighten the durability of the photosensitive member.

However, since a dark resistance of the a-Si carrier generation layer (3*a*) itself is $10^{11}$ Ω.cm or less, this a-Si photosensitive member has shown a problem of residual image that the dark-attenuation speed of this photosensitive member is increased and its own charge-acceptance becomes difficult to heighten, whereby the preceding image can not be completely removed to be remained by an optical memory effect and appears again in the formation of the following image when this photosensitive member is used in the high-speed copying.

Above problem has been expressed as residual image, but this expression is used only in the specification of the present invention.

In order to solve this problem, a separated function type photosensitive member as shown in FIG. 3 has been proposed.

That is to say, referring to FIG. 3, a carrier transport layer (5*a*) is formed between said carrier barrier layer (2*a* ) and said carrier generation layer (3*a*). And, said carrier transport layer (5*a*) is formed of materials having the large dark resistance and carrier mobility, whereby a high-performance photosensitive member, which is superior in surface potential and photosensitivity and shows a reduced residual potential, can be obtained. As a result, the residual image is not produced.

The carrier transport layer (5*a*) formed of hydrogenated amorphous silicon carbide having a high resistance and wide band gap and semiconductor characteristics has been proposed to use in Japanese Patent Laid-Open No. 192046/1983 and the like.

In addition, a small-sized and high-fidelity semiconductor laser has been used for a laser source with the development of a laser beam printer capable of carrying out the high-speed printing but since the oscillation wavelength of the laser rays is close to a near-infrared range, so that the photosensitive characteristics of the a-Si photosensitive member on the light-receiving side are inferior when the a-Si photosensitive member is carried on this printer. In order to solve this problem, a method, in which the a-Si photoconductive layer of the photosensitive member is doped with a suitable quantity of germanium element (Ge) to shift a photosensitive range of this layer to a longer wavelength side, has been proposed but a problem has occurred in that the surface potential is reduced.

In order to solve such problem, a separated function type photosensitive member as shown in FIG. 4 has been proposed in Japanese Patent Laid-Open No. 192044/1983.

That is to say, referring to FIG. 4, a multi-layer member comprising a carrier transport layer (2*a*) formed of amorphous silicon carbide (hereinafter referred to as a-Si for short), a carrier generation layer (3*a*) formed of amorphous silicon germanium (hereinafter referred to a-SiGe) and a surface protection layer (4*a*) formed on an electrically conductive substrate (1*a*) in turn has been proposed. And, the carrier transport layer (2*a*) is formed of materials capable of being a material having a large dark resistance and carrier mobility, whereby aiming at the superior surface potential and photosensitivity and the reduced residual potential.

However, in the formation of the carrier transport layer formed of hydrogenated a-SiC disclosed in these Japanese Patent Laid-Open No. 192046/1983 and Japanese Patent Laid-Open No. 192044/1983 in the case where an atomic ratio of silicon element (Si) to carbon element (C) is set at 1:9 to 9:1, the carrier mobility has a tendency to be lowered, whereby the carrier becomes easy to be trapped in the a-SiC carrier transport layer and thus the photosensitivity becomes difficult to be heightened and the residual potential becomes difficult to still more reduce. As a result, the background smearing is apt to be produced.

In addition, in the semiconductor laser beam printer, since the light source is coherent rays, a problem occurs in that an interferential fringe pattern is apt to be produced on an image. It is the reason why this interferential fringe pattern is produced that the coherent rays arrive at the substrate and the rays reflected by the substrate interfere with incident rays. In order to solve this problem, a method, in which a surface of the substrate is treated so as to show an appointed surface roughness to diffusedly reflect the rays arriving at the substrate, has been proposed. However, this roughening treatment of surface inevitably leads to an increased cost of production and thus the solution without requiring that treatment has been desired.

OBJECT OF THE INVENTION

Accordingly, the present invention was achieved in view of the above described matters and it is a first object of the present invention to provide an electrophotographic sensitive member of which carrier mobility of an a-SiC carrier transport layer is still more improved, whereby reducing a residual potential to prevent a background smearing from being produced.

It is a second object of the present invention to provide an electrophotographic sensitive member for use in a semiconductor laser beam printer capable of carrying out the high-speed copying and the high-speed printing.

It is a third object of the present invention to provide an electrophotographic sensitive member which does not produce an interferential fringe pattern on an image and high charge acceptance was obtained.

MEASURES FOR SOLVING THE PROBLEMS

According to the present invention, as for the above described first object, an electrophotographic sensitive member comprising at least a carrier transport layer and a carrier generation layer formed on a substrate, characterized by that said carrier transport layer is formed of a-SiC and an atomic ratio of C and Si is set at 1:100 to 1:9, or an electrophotographic sensitive member comprising at least a carrier barrier layer, a carrier transport layer and a carrier generation layer formed on a substrate, characterized by that said carrier barrier layer is formed of a-SiC, an atomic ratio of C and Si being set at 1:9 to 9:1, or a-Si comprising at least one of oxygen and nitrogen at a ratio of 0.1 to 30 atomic %, said carrier transport layer being formed of a-SiC, and an atomic ratio of C and Si being set at 1:100 to 1:9, is provided.

Next, as for the second object of the present invention, an electrophotographic sensitive member comprising at least a carrier transport layer and a carrier generation layer formed on a substrate, characterized by that said carrier transport layer is formed of a-SiC, an atomic ratio of C and Si being set at 1:100 to 1:9, said carrier generation layer being formed of a-SiGe, and an atomic ratio of Si and Ge being st at 2:1 to 100:1, or an electrophotographic sensitive member comprising at least a carrier barrier layer, a carrier transport layer and a carrier generation layer formed on a substrate, characterized by that said carrier barrier layer is formed of a-SiC, an atomic ratio of C and Si being set at 1:9 to 9:1, said carrier transport layer being formed of a-SiC, an atomic ratio of C and Si being set at 1:100 to 1:9, said carrier generation layer being formed of a-SiGe, and an atomic ratio of Si and Ge being set at 2:1 to 100:1, is provided.

In addition, as for the third object of the present invention, an electrophotographic sensitive member comprising at least a carrier transport layer and a carrier generation layer formed on a substrate, characterized by that said carrier transport layer is formed of a-SiC, an atomic ratio of C and Si being set at 1:100 to 1:9, said carrier generation layer being formed of a-SiGeC, an atomic ratio of Si and Ge being set at 2:1 to 100:1, and an atomic ratio of Si and C being set at 1:1 to 100:1, or an electrophotographic sensitive layer comprising at least a carrier barrier layer, a carrier transport layer and a carrier generation layer formed on a substrate, characterized by that said carrier barrier layer is formed of a-SiC, an atomic ratio of C and Si being set at 1:9 to 9:1, said carrier transport layer being formed of a-SiC, an atomic ratio of C and Si being set at 1:100 to 1:9, said carrier generation layer being formed of a-SiGeC, an atomic ratio of Si and Ge being set at 2:1 to 100:1, and an atomic ratio of Si and C being set at 1:1 to 100:1, is provided.

The present invention will be below described in detail with reference to the drawings, in which FIG. 1 is a sectional view showing one example of a construction of layers in an electrophotographic sensitive member according to the present invention;

Figure 1:
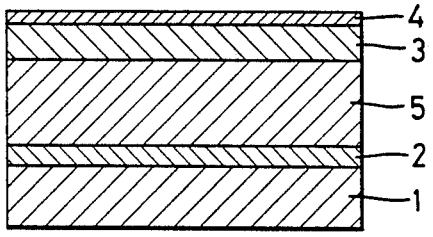
Figure 2:
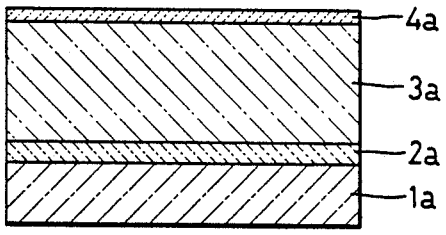
FIG. 2 is a sectional view showing a construction of layers in the conventional amorphous silicon photosensitive member.
Figure 3:
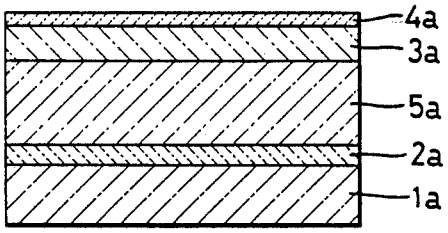
FIGS. 3, 4 are sectional views showing a construction of layers in the conventional separated function type photosensitive member.
Figure 4:
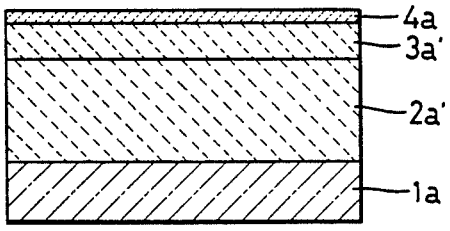

FIG. 1 shows a typical construction of layers in an electrophotographic sensitive member according to the present invention. Referring now to FIG. 1, a carrier barrier layer (2), a carrier transport layer (5), a carrier generation layer (3) and a surface protection layer (4) are formed on an electrically conductive substrate (1) in turn to obtain a multi-layer type photosensitive member. In this time, the order of forming the carrier transport layer (5) and the carrier generation layer (3) may be reversed. In addition, the carrier barrier layer (2) may be not formed.

The present invention is characterized by that an atomic ratio of an element C and an element Si is set at 1:100 to 1:9, to preferably 1:50 to 1:9, in the formation of said carrier transport layer (5) from a-SiC to improve the carrier mobility of the carrier transport layer (5), said carrier generation layer (3) being formed of a-SiC to heighten the charge acceptance and photosensitivity, or the carrier generation layer (3) being formed of a-SiGe or a-SiGeC and an atomic ratio thereof being set at an appointed range to heighten the photosensitivity for a light of long wavelength.

In addition, the present invention is characterized by that the carrier barrier layer (2) is formed of a-SiC, of which atomic ratio is set at an appointed range, of a-Si containing oxygen or nitrogen at an appointed range of ratio to increase the surface potential and reduce the darkness-attenuation speed and the residual potential of the photosensitive member.

Furthermore, the present invention is characterized by that the carrier barrier layer (2) is formed of a-SiC to still more increase the charge acceptance and reduce the darkness-attenuation speed and the residual potential.

At first, it is a reason why the atomic ratio in the carrier transport layer (5) is set at the above described range that if the atomic ratio of the element C and the element Si is smaller than 1:100, an effect of increasing the dark resistance and heighten the surface potential of the carrier transport is reduced while if this atomic ratio is larger than 1:9, the dark resistance of the carrier transport layer is increased and the surface potential of the carrier transport layer is heightened but the carrier mobility shows a tendency to reduce, whereby the residual potential is increased to be apt to produce a background smearing.

A thickness of the above described carrier transport layer (5) is set at 1 to 50 μm, preferably 5 to 30 μm. If it is less than 1 μm, the carrier transport layer (5) is inferior in charge acceptance, while if it exceeds 50 μm, the resolution power of image is deteriorated and the residual potential is increased.

This carrier transport layer (5) may comprise elements of the group Va in the periodic table (hereinafter referred to as elements of the group Va in the periodic table for short) or elements of the group IIIa in the periodic table (hereinafter referred to as elements of the group IIIa for short) at the desired ratio.

That is to say, in the case where the elements of the group Va are comprised, if they are comprised at a ratio of 0 to 10,000 ppm, preferably 0.1 to 1,000 ppm, a photosensitive member advantageous for the negative charge is obtained. Said elements of the group Va include P, N, As, Sb and the like. Above all, P is desirable.

In addition, in the case where the elements of the group IIIa are comprised, they are comprised at a ratio of 0.1 to 10,000 ppm, preferably 0.5 to 1,000 ppm, a photosensitive member advantageous for the positive charge is obtained. Said elements of the group IIIa include B, Al, Ga, In and the like. Above all, B is desirable.

In the case where the above described impurity elements are doped to charge in the desired manner, in order to still more increase the dark resistance to heighten the surface potential, the addition of the elements of the group IIIa is advantageous.

Photoelectric materials, which have been known in themselves, can be used as said carrier generation layer (3). Organic semiconductors, such as PVK, and inorganic semiconductors, such as Se, Se-Te, Se-As, CdS, ZnO, a-Si, a-SiC, a-SiGe and a-SiGeC, are used.

Of them, in the case where an atomic ratio of C and Si of a-SiC as the carrier generation layer (3) is set at a range, in which a-SiC shows the photoconductivity, and formed in combination with the a-SiC carrier transport layer (5), the atomic ratio of Cd and Si is set at 1:100 to 9:1, preferably 1:20 to 1:1. If the atomic ratio of C and Si is within this range, a photosensitive member superior in photoconductivity and having a reduced potential and the high charge acceptance and thus an increased image concentration is obtained.

Furthermore, in the case where the elements of the group Va or IIIa are comprised in both the a-SiC carrier transport layer (5) and the a-SiC carrier generation layer (3), it is preferable that the carrier transport layer (5) comprises them in a quantity larger than that in the carrier generation layer (3). Thus, the excited carriers generated in the carrier generation layer (3) are smoothly poured into the carrier transport layer (5) to advantageously effect to the reduction of the residual potential.

Besides, if said carrier generation layer (3) is formed of a-SiGe, the peak spectrosensitivity is shifted toward a longer wavelength side in comparison with that formed of a-Si. It is important for this layer (3) that the atomic ration of Si and Ge is set at 2:1 to 100:1, preferably 3:1 to 10:1. Thus, the photosensitive characteristics for a semiconductor laser beam having an oscillation wavelength of about 780 nm are remarkably improved in comparison with those of the photosensitive member comprising the a-Si carrier generation layer. And, according to the experiments conducted by the present inventors, it is desired for the separated function type photosensitive member comprising an a-SiC carrier transport layer to set an atomic ratio of Si and Ge at 3:1 to 10:1 and the residual potential is reduced to obtain a photosensitive member having a still more heightened charge acceptance within such range of atomic ratio of Si and Ge.

In addition, this carrier generation layer (3) is formed of a-SiGeC and tested on the spectrosensitive characteristics with the results that the photosensitivity can be heightened particularly in the wavelength range of 650 to 850 nm and thus becomes suitable for a photosensitive member for use in the semiconductor laser beam printer.

Furthermore, in the case where this a-SiGeC carrier generation layer (3) is combined with the a-SiC carrier transport layer (5) in the order shown in FIG. 1, the carrier transport layer (5) serves to not only transport the carriers generated in the carrier generation layer (3) but also maintain the potential. In addition, it serves to prevent the carriers from being poured from the substrate (1).

In the case where said carrier transport layer (5) is disposed between the carrier generation layer and the substrate in the above manner, the mobility of carriers of this layer itself comparatively high, so that the trapped carriers in this layer are remarkably reduced. As a result, the high photosensitive characteristics and the reduction the residual potential can be achieved.

According to the present invention, in the case where the carrier transport layer (5) is formed in the above described manner, the content of carbon is comparatively small, so that it becomes difficult to sufficiently heighten the charge acceptance but this disadvantage is compensated by the a-SiGeC carrier generation layer (3).

That is to say, the carbon content of the carrier transport layer is small, so that the dark resistance can not be set at a sufficiently large value but carbon is contained in the a-SiGeC carrier generation layer (3), whereby the charge acceptance of the photosensitive member can be sufficiently increased.

Furthermore, according to the present invention, the photocarriers are substantially generated in the a-SiGeC carrier generation layer (3) by the building-up shown in FIG. 1, whereby the incident ray does not reach the substrate (1). As a result, a problem of producing an interferential fringe pattern on the image can be solved.

As for this carrier generation layer (3), it is sufficient to set the atomic ratio of the element Si and the element Ge at 2:1 to 100:1, preferably 3:1 to 30:1. Thus, the absorption coefficient of light having long wavelength can be increased, whereby not only the photosensitivity can be heightened but also the interferential fringe due to the laser beam can be prevented from being produced.

In addition, it is desired that the atomic ratio of the element Si and the element C is set at 1:1 to 100:1, preferably 3:1 to 100:1, and thus, the dark conductivity can be sufficiently reduced to improve the charge acceptance.

Besides, the thickness of the carrier generation layer (3) is optionally chosen so that this layer may be substantially a layer for generating photocarriers but according to the results of the experiments by the present inventors in which the thickness of the carrier generation layer (3) was varied, if the thickness of the carrier generation layer (3) is set so that the transmittance of the incident ray through the carrier generation layer (3) may be 30% or less, preferably 20% or less, the light does not reach the substrate (1) at all. The transmittance of this layer (3) can be reduced with an increase of the thickness while the residual potential of the photosensitive member shows a tendency to increase. Accordingly, the thickness of the carrier generation layer (3) is chosen depending upon the transmittance and the residual potential. It was found from the repeated experiments by the present inventors that it is desired to set the thickness of the carrier generation layer (3) at 1 to 100 μm. preferably 1 to 30 μm, and optimumly 1 to 5 μm.

Said carrier barrier layer (2) is formed for preventing the carriers from being poured into the carrier transport layer (5) and formed of organic materials, such as polyimide resin, and inorganic materials, such as $SiO_2$, SiO, $Al_2O_3$, SiC, $Si_3N_4$, a-Si and a-SiC. And, in the case where the carrier barrier layer (2) is formed of a-SiC, it is desired to set the atomic ratio of the element C and the element Si at 1:9 to 9:1, preferably 2:8 to 8:2.

In the case where the atomic ratio of the element C and the element Si is smaller than 1:9, the effect of preventing the carriers from being poured from the substrate side is insufficient, whereby the surface potential is reduced and the darkness-attenuation speed is increased while in the case where the atomic ratio of the element C and the element Si is larger than 9:1, the effect of preventing the excited carriers from being poured from the substrate side is enhanced to increase the residual potential.

In addition, in the case where the carrier barrier layer (2) is formed of a-Si containing at least one of oxygen and nitrogen a ratio of 0.1 to 30 atomic %, preferably 1 to 20 atomic %, and these elements are contained at a ratio smaller than 0.1 atomic %, the effect of preventing the carriers from being poured from the substrate side is insufficient, whereby the surface potential is reduced and the darkness-attenuation speed is increased while in the case where these elements are contained at a ratio exceeding 30 atomic %, the effect of preventing the excited carriers from being poured into the substrate side is enhanced to increase the residual potential.

In addition, in the formation of the carrier barrier layer (2) from semiconductor materials, in the case where the photosensitive member is positively charged, it is desired to control the conduction mode at P type while in the case where the photosensitive member is negatively charged, it is desired to control the conduction mode at N type. Thus, the effect of preventing the carriers from being poured is still more improved. For example, the elements of the group IIIa, such as B, are contained in these P type semiconductor materials and the elements of the group Va, such as P, in these N type semiconductor materials at a ratio of 50 to 10,000 ppm, respectively.

In addition, it is desired to set the thickness of the carrier barrier layer (2) at 0.2 to 5.0 μm, preferably 0.5 to 3.0 μm. Thus, a performance of the carrier barrier layer (2) of preventing from the carriers from being poured thereinto from the substrate becomes sufficient and the residual potential is reduced which are desirable.

Besides, in the case where the elements of the group Va or the elements of the group IIIa are contained in both the a-Si carrier barrier layer (2) and the a-SiC carrier transport layer (5), it is desired that they are contained in the carrier barrier layer (2) in a quantity larger than that in the carrier transport layer (5), and thus the effect of preventing the carriers from being poured advantageously comes into play.

Furthermore, according to the repeated experiments conducted by the present inventors, if the dark resistance of the carrier transport layer (5) is $10^{13}$ Ω.cm or more, it can be sufficiently used practically as an electrophotosensitive member even though the carrier barrier layer (2) is not formed.

According to the present invention, said carrier transport layer (5) is substantially formed of a-Si, a-SiC, a-SiGe or a-SiGeC, the carrier barrier layer (2) being substantially formed of a-Si, a-SiC, a-SiGe and a-SiGeC, and the carrier generation layer (3) being substantially formed of a-SiC, a-SiGe, a-SiGeC and the like but it is necessary for terminating the dangling bond, which is under an amorphous condition, to contain a hydrogen element (H) and a halogen element. These elements are contained at a ratio of 5 to 50 atomic %, preferably 5 to 40 atomic %, and optimumly 10 to 30 atomic %. Usually, the hydrogen atom is used. If the hydrogen element is used, it is apt to be incorporated in the above described terminating end portion, so that a density of the localized state in the band gap is reduced, whereby the superior semiconductor characteristics are obtained.

In addition, a part of this H element may be substituted by the halogen element, whereby the density of the localized state of this layer can be reduced to heighten the photoconductivity and heat-resistance (temperature characteristics). It is desired that the substitution ratio is 0.01 to 50 atomic %, preferably 1 to 10 atomic %, based on all elements in the terminating end portion of the dangling bond. This halogen element includes F, Cl, Br, I, At and the like. Above all, the use of F is desired in view of the fact that its large electrical negativity leads to an increased bond between atoms, whereby the thermal stability is improved.

Said surface protection layer (4) can be formed of every material which is highly insulating and has a high corrosion-resistance and high hardness characteristics in itself. For example, the same inorganic or organic materials as used for said carrier barrier layer (2) can be used. Thus, the durability and environment-resistance of the photosensitive member can be heightened.

Next, a method of producing an electrophotographic sensitive member according to the present invention.

In the present invention, the carrier transport layer and carrier barrier layer formed of a-SiC and the carrier generation layer formed of a-SiC, a-SiGe or a-SiGeC can be formed by the thin film-forming methods such as the glow discharge decomposition method, the ion plating method, the reactive sputtering method, the vacuum evaporation method, the thermal CVD method and the like. In addition, the material used here may be solid, liquid or gas.

For example, the gaseous materials used for the glow discharge decomposition method include gases of Si series, such s $SiH_4$, $Si_2H_6$, $Si_3H_8$ and $SiF_4$, gases of C series, such as $CH_4$, $C_2H_2$, $C_2H_6$ and $C_3H_8$, and gases of Ge series, such as $GeH_4$ and $Ge_2H_6$. In addition, $H_2$, He, Ne, Ar and the like are used as the carrier gas.

And, in the case where the layers other than those hereinbefore specified as objects of the invention are formed according to the parameters described for such layers, if those layers are formed of a-Si or a-SiC, an advantage occurs in that the similar thin film-forming method can be used. Furthermore, in the case where the same one film-forming apparatus is used, an advantage occurs in that the layers can be continuously piled up by means of the common thin film-forming means.

Next, a method of forming a-Si or a-SiC in the case where an electrophotographic sensitive member used in one preferred embodiment of the present invention is formed of a-Si or a-SiC by the glow discharge decomposition method is described with reference to a capacitively coupled type glow discharge decomposition apparatus shown in FIG. 5.

Figure 5:
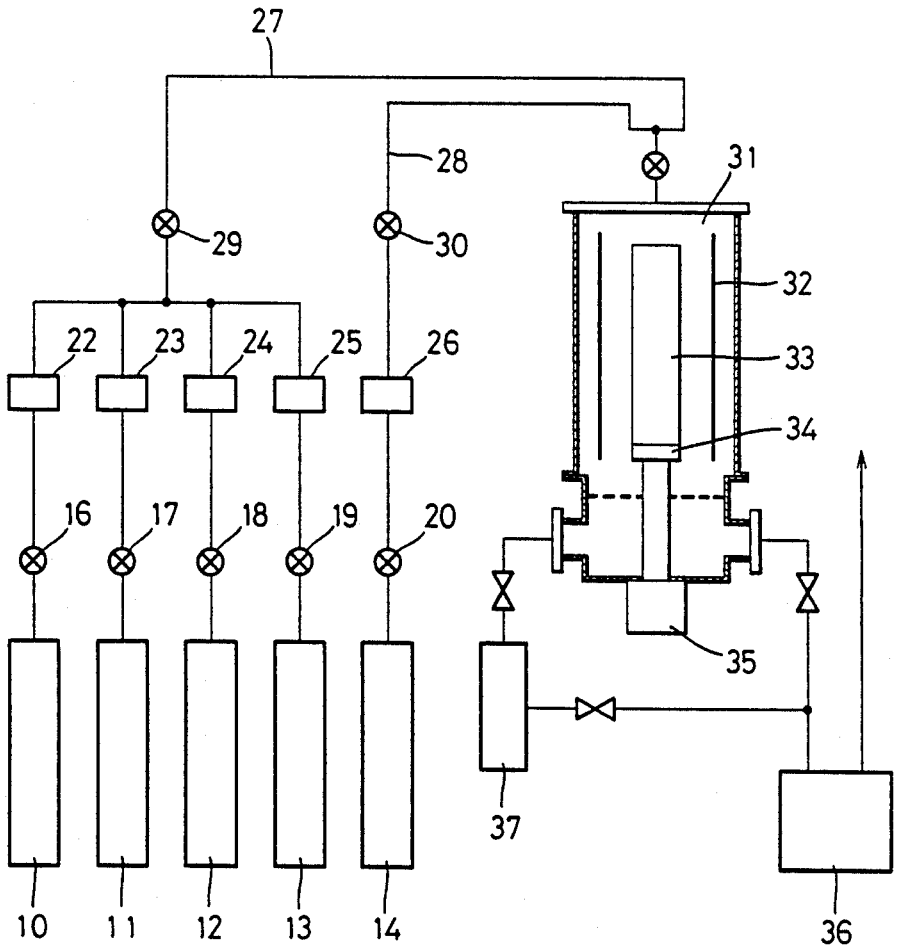
FIGS. 5, 6 are schematic drawings showing a capacitively coupled type glow discharge decomposition apparatus.

Referring now to FIG. 5, a tank (10), (11), (12), (13), (14) is tightly filled with $SiH_4$ gas, $C_2H_2$ gas, $B_2H_6$ gas (diluted to 20 ppm with $H_2$ gas), $H_2$ gas and NO gas, respectively, and $H_2$ is used as also a carrier gas. These gases are discharged by opening the corresponding regulating valves (16), (17), (18), (19), (20), their flow rates being controlled by means of mass flow controllers (22), (23), (24), (25), (26), and the gases from the tanks (10), (11), (12), (13) being transferred to a main pipe (27) while NO gas from the tank (14) is transferred to a main pipe (28). In addition, reference numerals (29), (30) designate a stop valve. The gases flowing through the main pipes (27), (28) are sent in a reaction tube (31). Said reaction tube (31) is provided with a capacitively coupled type discharge electrode (32) disposed therewithin and a high frequency-electric power of 50 W to 3 KW having a frequency of 1 MHz to 50 MHz is suitably applied to said capacitively coupled type discharge electrode (32). A cylindrical film-forming substrate (33) formed of aluminum is placed on a sample-holding table (34) within the reaction tube (31), said sample-holding table (34) being rotatably driven by a motor (35), and said substrate (33) being uniformly heated at temperatures of about 200° to 400° C., preferably of about 200° to 350° C., by means of a suitable heating means. In addition, since a high vacuum condition (a pressure of gas is 0.1 to 2.0 Torr when discharged) is required within an inside of the reaction tube (31) during a time when the a-SiC film is formed, the inside of the reaction tube (31) is connected with a rotary pump (36) and a diffusion pump (37).

With the glow discharge decomposition apparatus constructed in the above described manner, in the case where for example the a-SiC film is formed on the substrate (33), the regulating valves (16), (17), (19) are opened to emit $SiH_4$ gas, $C_2H_2$ gas and $H_2$ gas, respectively. Their flow rates are controlled by means of the mass flow controllers (22), (23), (25) and a mixture of these gases is flown in the reaction tube (31) through the main pipe (27). When the inside of the reaction tube (31) is set at the vacuum condition of about 0.1 to 2.0 Torr, the substrate temperature at 200° to 400° C., the high-frequency electric power of the combined capacity type discharge electrode (32) at 50 W to 3 KW, and the frequency at 1 to 50 MHz, the glow discharge occurs to decompose the gas, whereby the a-SiC film is formed on the substrate at high speed.

Furthermore, a method of forming a-SiC or a-SiGe or a-SiGeC in the case where an electrophotographic sensitive member disclosed in another preferred embodiment of the present invention is formed of a-SiC or a-SiGe or a-SiGeC by the glow discharge decomposition method is described with reference to a capacitively coupled type glow discharge decomposition apparatus shown in FIG. 6.

Figure 6:
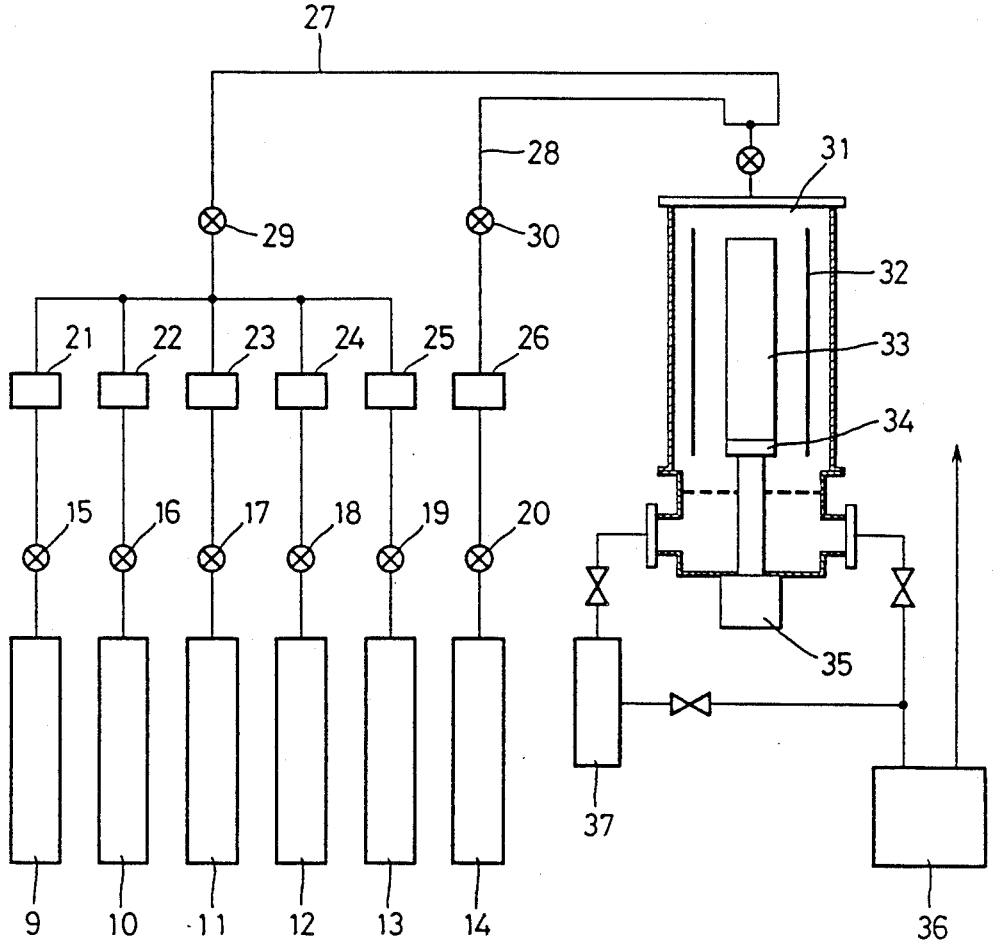

Referring to FIG. 6, $SiH_4$ gas, $C_2H_2$ gas, $GeH_4$ gas, $B_2H_6$ gas (diluted to 20 ppm with $H_2$ gas). $H_2$ gas and NO gas is enclosed in a tank (9), (10), (11), (12), (13), (14), respectively, and $H_2$ is used as also a carrier gas. These gases are discharged by opening the corresponding regulating valves (15), (16), (17), (18), (19), (20), their flow rates being controlled by means of mass flow controllers (21), (22), (23), (24), (25), (26), and the gases from the tanks (9), (10), (11), (12), (13) being transferred to a main pipe (27) while NO gas from the tank (14) is transferred to a main pipe (28). In addition, reference numerals (29), (30) designate a stop valve. The gases flowing through the main pipes (27), (28) are sent in a reaction tube (31). Said reaction tube (31) is provided with a capacitively coupled type discharge electrode (32) disposed therewithin and a high-frequency electric power of 50 W to 3 KW having a frequency of 1 MHz to 50 MHz is suitably applied to said capacitively coupled type discharge electrode (32). A cylindrical film-forming substrate (33) formed of aluminum is placed on a sample-holding table (34) within the reaction tube (31), said sample-holding table (34) being rotatably driven by a motor (35), and said substrate (33) being uniformly heated at temperatures of about 200° to 400° C., preferably of about 200° to 350° C., by means of a suitable heating means. In addition, since a high vacuum condition (a pressure of gas is 0.1 to 2.0 Torr when discharged) is required within an inside of the reaction tube (31) during a time when the a-SiC film is formed, the inside of the reaction tube (31) is connected with a rotary pump (36) and a diffusion pump (37).

With the glow discharge decomposition apparatus constructed in the above described manner, in the case where for example the a-SiGe film is formed on the substrate (33), the regulating valves (15), (17), (19) are opened to emit $SiH_4$ gas, $GeH_4$ gas and $H_2$ gas, respectively. Their flow rates are controlled by means of the mass flow controllers (21), (23), (25) and a mixture of these gases is flown in the reaction tube (31) through the main pipe (27).

Besides, in the case where for example the a-SiGeC film is formed on the substrate (33), the regulating valves (15), (16), (17), (19) are opened to emit $SiH_4$ gas, $C_2H_2$ gas, $GeH_4$ gas and $H_2$ gas, respectively. Their flow rates are controlled by means of the mass flow controllers (21), (22), (23), (25) and a mixture of these gases is flown in the reaction tube (31) through the main pipe (27).

And, when the inside of the reaction tube (31) is set at the vacuum condition of about 0.1 to 2.0 Torr, the substrate temperature at 200 ° to 400° C., the high-frequency electric power of the capacitively coupled type discharge electrodes (32) at 50 W to 3 KW, and the frequency at 1 to 50 MHz, the glow discharge occurs to decompose the gas, whereby the a-SiGe film or the a-SiGeC film is formed on the substrate at high speed.

In addition, although $H_2$ gas is used in the above described example of the formation of the a-SiGeC carrier generation layer (3), this gas is not indispensable, that is, the a-SiGeC carrier generation layer (3) can be formed without using $H_2$ gas.

PREFERRED EMBODIMENTS

The present invention will be described in more detail with reference to the preferred embodiments.

EXAMPLE 1

The carrier barrier layer (2), the carrier transport layer (5), the carrier generation layer (3) and the surface protection layer (4) were formed on the substrate (33) (substrate (1) in FIG. 1) in turn under the manufacturing conditions shown in Tables 1 to 3 by the use of the glow discharge decomposition apparatus shown in FIG. 5 to produce an electrophotographic sensitive member drum.

In addition, $B_2H_6$ gas marked with * in the tables contains $B_2H_6$ at a ratio of 0.2% by diluting with hydrogen.

TABLE 1

| Structure of layers | Flow rate of gas (sccm) $SiH_4$ | $C_2H_2$ | $H_2$ | $B_2H_6$ | NO | Pressure (Torr) | High-frequency electric power (W) | Film-forming time (min) | Layer thickness (μm) |
|---|---|---|---|---|---|---|---|---|---|
| Surface protection layer | 60 | 60 | — | — | — | 0.35 | 100 | 4 | 0.5 |
| Carrier generation layer | 100 | — | 300 | — | — | 0.45 | 150 | 25 | 3.0 |
| Carrier transport layer | 150 | 3 | 200 | 100 | — | 0.5 | 150 | 210 | 26.5 |
| Carrier barrier layer | 100 | — | 200 | 100* | — | 0.5 | 100 | 40 | 2.5 |

TABLE 2

| Structure of layers | Flow rate of gas (sccm) $SiH_4$ | $C_2H_2$ | $H_2$ | $B_2H_6$ | NO | Pressure (Torr) | High-frequency electric power (W) | Film-forming time (min) | Layer thickness (μm) |
|---|---|---|---|---|---|---|---|---|---|
| Surface protection layer | 60 | 60 | — | — | — | 0.35 | 100 | 4 | 0.5 |
| Carrier generation layer | 100 | — | 300 | — | — | 0.45 | 150 | 25 | 3.0 |
| Carrier transport layer | 150 | 3 | 200 | 100 | — | 0.5 | 150 | 210 | 26.5 |
| Carrier barrier layer | 100 | 30 | 200 | 100* | 2.5 | 0.5 | 100 | 35 | 2.5 |

TABLE 3

| Structure of layers | Flow rate of gas (sccm) $SiH_4$ | $C_2H_2$ | $H_2$ | $B_2H_6$ | NO | Pressure (Torr) | High-frequency electric power (W) | Film-forming time (min) | Layer thickness (μm) |
|---|---|---|---|---|---|---|---|---|---|
| Surface protection layer | 60 | 60 | — | — | — | 0.35 | 100 | 4 | 0.5 |
| Carrier generation layer | 100 | — | 300 | — | — | 0.45 | 150 | 17 | 2.0 |
| Carrier transport layer | 150 | 3 | 200 | 100 | — | 0.5 | 150 | 255 | 28.0 |
| Carrier barrier layer | 100 | — | 200 | 50* | 5 | 0.5 | 100 | 40 | 2.5 |

The photosensitive member obtained in the above described manner was subjected to a corona charging at +5.6 KV with the result that the surface potential amounted to about 700 to 900 V. In addition, a monochromatic light having a wavelength of 650 nm was incident upon this photosensitive member (an exposure dose of 0.3 $\mu W/cm^2$) with the result that the photosensitivity amounted to 0.50 $cm^2erg^{-1}$ and the residual potential was remarkably reduced to about 20 V. And, this photosensitive member drum was mounted on the super-high speed copying machine (a copying speed of 70 pieces/min) and an image was obtained with the result that no background smearing was shown but the image showing a high concentration and a high distinction was obtained.

In addition, a part of the above described film-forming substrate (33) was cut away and a rectangular flat plate formed of aluminum having a size of 3×3 cm was mounted on the resulting cut-away portion. Subsequently, the above described carrier transport layer was formed on this flat plate under the conditions shown in Tables 2, 3 and then the ratio of C and Si contained in the film was determined by the Auger electron spectrophotometric method with the result that it was 1:30.

EXAMPLE 2

The carrier transport layer (5), the carrier generation layer (3) and the surface protection layer (4) were formed in turn on the substrate (33) under the manufacturing conditions shown in Table 4 by the use of the glow discharge decomposition apparatus shown in FIG. 5 to produce an electrophotographic sensitive member drum.

TABLE 4

| Structure of layers | Flow rate of gas (sccm) $SiH_4$ | $C_2H_2$ | $H_2$ | $B_2H_6$ | NO | Pressure (Torr) | High-frequency electric power (W) | Film-forming time (min) | Layer thickness (μm) |
|---|---|---|---|---|---|---|---|---|---|
| Surface protection layer | 60 | 60 | — | — | — | 0.35 | 100 | 4 | 0.5 |
| Carrier generation | 100 | 20 | 300 | — | — | 0.45 | 150 | 15 | 2.0 |

TABLE 4-continued

| Structure of layers | Flow rate of gas (sccm) $SiH_4$ | $C_2H_2$ | $H_2$ | $B_2H_6$ | NO | Pressure (Torr) | High-frequency electric power (W) | Film-forming time (min) | Layer thickness (μm) |
|---|---|---|---|---|---|---|---|---|---|
| layer | | | | | | | | | |
| Carrier transport layer | 150 | 3 | 200 | 100 | — | 0.5 | 150 | 200 | 25.0 |

EXAMPLE 3

The carrier transport layer (5), the carrier generation layer (3) and the surface protection layer were formed on the substrate (33) in turn under the conditions shown in Table 5 by the use of the glow discharge decomposition apparatus shown in FIG. 5 to produce an electrophotographic sensitive member drum. In addition, NO gas is used for the formation of the carrier barrier layer (2) to dope oxygen and nitrogen, whereby the adhesion of the carrier barrier layer (2) to the substrate is enhanced.

$B_2H_6$ gas marked with * contains $B_2H_6$ at a ration of 20 ppm by diluting with hydrogen.

TABLE 5

| Structure of layers | Flow rate of gas (sccm) $SiH_4$ | $C_2H_2$ | $H_2$ | $B_2H_6$ | NO | Pressure (Torr) | High-frequency electric power (W) | Film-forming time (min) | Layer thickness (μm) |
|---|---|---|---|---|---|---|---|---|---|
| Surface protection layer | 60 | 60 | — | — | — | 0.35 | 100 | 4 | 0.5 |
| Carrier generation layer | 100 | 20 | 300 | — | — | 0.45 | 150 | 15 | 2.0 |
| Carrier transport layer | 150 | 3 | 200 | 100 | — | 0.5 | 150 | 200 | 25.0 |
| Carrier barrier layer | 100 | 30 | 200 | 100* | 2.5 | 0.5 | 100 | 35 | 2.5 |

EXAMPLE 4

The carrier transport layer (5), the carrier generation layer (3) and the surface protection layer (4) were formed on the substrate (33) in turn under the conditions shown in Table 6 by the use of the glow discharge decomposition apparatus shown in FIG. 6 to produce an electrophotographic sensitive member drum.

Table 6

| Structure of layers | Flow rate of gas (sccm) $SiH_4$ | $C_2H_2$ | $GeH_4$ | $H_2$ | $B_2H_6$ | NO | Pressure (Torr) | High-frequency electric power (W) | Film-forming time (min) | Layer thickness (μm) |
|---|---|---|---|---|---|---|---|---|---|---|
| Surface protection layer | 60 | 60 | — | — | — | — | 0.35 | 100 | 4 | 0.5 |
| Carrier generation layer | 100 | — | 30 | 300 | — | — | 0.45 | 150 | 22 | 3.0 |
| Carrier transport layer | 150 | 3 | — | 200 | 100 | — | 0.5 | 150 | 225 | 28.0 |

EXAMPLE 5

The carrier barrier layer (2), the carrier transport layer (5), the carrier generation layer (3) and the surface protection layer (4) were formed on the substrate (33) in turn under the manufacturing conditions shown in Table 7 by the use of the glow discharge decomposition apparatus shown in FIG. 6 to produce an electrophotographic sensitive member drum. In addition, NO gas is used for the formation of the carrier barrier layer (2) to dope oxygen and nitrogen, whereby the adhesion of the carrier barrier layer (2) to the substrate is enhanced.

$B_2H_6$ gas marked with * contains $B_2H_6$ at a ratio of 0.2% by diluting with hydrogen.

TABLE 7

| Structure of layers | Flow rate of gas (sccm) $SiH_4$ | $C_2H_2$ | $GeH_4$ | $H_2$ | $B_2H_6$ | NO | Pressure (Torr) | High-frequency electric power (W) | Film-forming time (min) | Layer thickness (μm) |
|---|---|---|---|---|---|---|---|---|---|---|
| Surface protection layer | 60 | 60 | — | — | — | — | 0.35 | 100 | 4 | 0.5 |
| Carrier generation layer | 100 | — | 30 | 300 | | | 0.45 | 150 | 22 | 3.0 |
| Carrier transport layer | 150 | 3 | — | 200 | 100 | — | 0.5 | 150 | 225 | 28.0 |
| Carrier barrier | 100 | 30 | — | 200 | 100* | 2.5 | 0.5 | 100 | 35 | 2.5 |

TABLE 7-continued

| Structure of layers | Flow rate of gas (sccm) | | | | | | Pressure | High-frequency electric power | Film-forming time | Layer thickness |
|---|---|---|---|---|---|---|---|---|---|---|
| | $SiH_4$ | $C_2H_2$ | $GeH_4$ | $H_2$ | $B_2H_6$ | NO | (Torr) | (W) | (min) | (μm) |
| layer | | | | | | | | | | |

EXAMPLE 6

The carrier transport layer (5), the carrier generation layer (3) and the surface protection layer (4) were formed on the substrate (33) in turn under the manufacturing conditions shown in Table 8 by the use of the glow discharge decomposition apparatus shown in FIG. 6 to produce an electrophotographic sensitive member drum.

TABLE 8

| Structure of layers | Flow rate of gas (sccm) | | | | | | Pressure | High-frequency electric power | Film-forming time | Layer thickness |
|---|---|---|---|---|---|---|---|---|---|---|
| | $SiH_4$ | $C_2H_2$ | $GeH_4$ | $H_2$ | $B_2H_6$ | NO | (Torr) | (W) | (min) | (μm) |
| Surface protection layer | 60 | 60 | — | — | — | — | 0.35 | 100 | 4 | 0.5 |
| Carrier generation layer | 100 | 10 | 10 | 300 | — | — | 0.45 | 150 | 18 | 2.5 |
| Carrier transport layer | 150 | 3 | — | 200 | 100 | — | 0.5 | 150 | 225 | 28.0 |

EXAMPLE 7

The carrier barrier layer (2), the carrier transport layer (5), the carrier generation layer (3) and the surface protection layer (4) were formed on the substrate (33) in turn under the manufacturing conditions shown in Table 9 by the use of the glow discharge decomposition apparatus shown in FIG. 6 to produce an electrophotographic sensitive member drum. In addition, NO gas is used for the formation of the carrier barrier layer (2) to dope oxygen and nitrogen, whereby the adhesion of the carrier barrier layer (2) to the substrate is enhanced.

In addition, $B_2H_6$ gas marked with * contains $B_2H_6$ at a ratio of 0.2% by diluting with hydrogen.

TABLE 9

| Structure layers | Flow rate of gas (sccm) | | | | | | Pressure | High-frequency electric power | Film-forming time | Layer thickness |
|---|---|---|---|---|---|---|---|---|---|---|
| | $SiH_4$ | $C_2H_2$ | $GeH_4$ | $H_2$ | $B_2H_6$ | NO | (Torr) | (W) | (min) | (μm) |
| Surface protection layer | 60 | 60 | — | — | — | — | 0.35 | 100 | 4 | 0.5 |
| Carrier generation layer | 100 | 10 | 10 | 300 | — | — | 0.45 | 150 | 18 | 2.5 |
| Carrier transport layer | 150 | 3 | — | 200 | 100 | — | 0.5 | 150 | 225 | 28.0 |
| Carrier barrier layer | 100 | 30 | — | 200 | 100* | 2.5 | 0.5 | 100 | 35 | 2.5 |

The photosensitive members obtained in the above described EXAMPLES 2 to 7 were subjected to a corona discharge at 5.6 Kv in the same manner as in EXAMPLE 1 with the result that the surface voltage amounted to about 700 to 900 V. In addition, a monochromatic light having a wavelength of 780 nm was incident upon these photosensitive members (an exposure dose of 0.3 $\mu W/cm^2$) with the result that the photosensitivity amounted to 0.20 $cm^2erg^{-1}$ and the residual potential was remarkably reduced to about 20 V. And, of these photosensitive member drums, the photosensitive member drums obtained in EXAMPLES 2, 3 were mounted on the super-high speed copying machine (a copying speed of 40 pieces/min) and the photosensitive member drums obtained in EXAMPLES 4 to 7 were mounted on the semiconductor laser beam printer (a copying speed of 40 pieces/min) followed by obtaining an image with the result that no background smearing was shown but the image showing a high concentration and a high distinction was obtained.

In addition, in EXAMPLES 6, 7 also no interference fringe was produced.

In addition, a part of the above described film-forming substrate (33) was cut away and a rectangular flat plate formed of aluminum having a size of 3×3 cm was mounted on the resulting cut-away portion. Subsequently, the above described carrier transport layer was formed on this flat plate under the conditions shown in the tables in the above described EXAMPLES and then the radio of C and Si contained in the film was determined by the Auger electron spectrophotometric method with result that it was 1:30.

EXAMPLE 8

The carrier transport layer (5) having thickness of 25 μm was formed with changing the flow rate of $C_2H_2$ gas in the formation of the carrier transport layer (5) in EXAMPLE 1 to 30 sccm and the film-forming time to 190 minutes and the carrier barrier layer (2), the carrier generation layer (3) and the surface protection layer (4) were formed under the same conditions as shown in Table 1 in EXAMPLE 1.

The surface potential, photosensitivity and residual potential of the resulting photosensitive member were measured under the same conditions as in EXAMPLE 1 with the result that they amount to about 900 V, 0.40 $cm^2erg^{-1}$ and about 50 V, respectively, and further the ratio of C and Si contained in the carrier transport layer was determined with the result that it was 1:3.

As above described, the above described resulting photosensitive member showed the surface potential higher than that of the photosensitive member obtained in EXAMPLE 1 but the photosensitivity was reduced and the residual potential was increased. And, this photosensitive member drum was mounted on the super-high speed copying machine (a copying speed of 70 pieces/min) under the severe conditions that the background smearing is apt to be produced most and an image was obtained with the result that the background smearing was slightly observed.

EXAMPLE 9

Next, the flow rates of $SiH_4$ gas and $C_2H_2$ gas in the formation of the carrier transport layer (5) in EXAMPLE 1 were changed to form the carrier transport layer (5) having a various kinds of composition of SiC and the carrier barrier layer (2), the carrier generation layer (3) and the surface protection layer (4) were formed under the same conditions as in EXAMPLE 1 to produce six kinds of photosensitive member (1 to 6).

The ratio of C and Si, surface potential, photosensitivity and residual potential of these photosensitive members are shown in Table 10.

The photosensitive members marked with * are outside of the present invention.

TABLE 10

| Photosensitive member | Ratio of C and Si contained in the carrier transport layer | Surface potential (V) | Photosensitivity ($cm^2erg^{-1}$) | Residual potential (V) |
|---|---|---|---|---|
| 1* | 1:200 | 430 | 0.60 | 10 |
| 2 | 1:70 | 583 | 0.56 | 18 |
| 3 | 1:40 | 715 | 0.52 | 25 |
| 4 | 1:20 | 827 | 0.47 | 28 |
| 5 | 1:15 | 840 | 0.46 | 33 |
| 6 * | 1:5 | 866 | 0.40 | 50 |

As obvious from Table 10, the photosensitive members 2, 3, 4, 5 show a high surface potential and a high photosensitivity. Furthermore, their residual potential is remarkably reduced. And, these photosensitive member drums were mounted on the super-high speed copying machine (a copying speed of 70 pieces/min) and an image was obtained with the result that no background smearing was shown but the image having a high concentration and a high distinction was obtained.

However, the photosensitive member 1 showed a low surface potential while the photosensitive member 6 was inferior in photosensitivity and its residual potential was increased.

EXAMPLE 10

The flow rates of $SiH_4$ gas and $C_2H_2$ gas in the formation of the carrier barrier layer (2) and the carrier transport layer (5) and the ratio of these gases in EXAMPLE 1 were changed to form the films having various kinds of composition, and the carrier generation layer (3) and the surface protection layer (4) were formed under the same conditions as in EXAMPLE 1 to produce 9 kinds of photosensitive member (7 to 15).

These resulting photosensitive members were mounted on the super-high speed copying machine (a copying speed of 70 pieces/min) under the severe conditions that the background smearing is apt to be produced most and an image was obtained with the result that the concentration of the resulting image or the concentration of the background smearing measured by means of the image concentration meter are shown in Table 11.

In addition, the evaluation of image quality in the table is classified into three marks ◎ , ○ and Δ. The mark ◎ indicates the case where the concentration of image is high and no background smearing is shown, the mark ○ indicating the case where the concentration of image is high, no background smearing being shown, and no substantial hindrance being provided, and the mark Δ indicating the case where the concentration of image is slightly reduced or the background smearing is slightly observed.

In addition, this evaluation of image quality is similar also in the following EXAMPLES 11 to 17.

The photosensitive members marked with * are outside of the present invention.

TABLE 11

| Kind of photosensitive member | Ratio of C and Si contained in the carrier transport | Ratio of C and Si contained in the carrier barrier layer | Concentration image | Concentration of the background smearing | Evaluation of image quality |
|---|---|---|---|---|---|
| 7 * | 1/150 | 1/3 | 0.89 | 0.05 | Δ |
| 8 * | 1/80 | 1/10 | 0.93 | 0.05 | Δ |
| 9 | 1/80 | 5/1 | 1.35 | 0.10 | ○ |
| 10 | 1/30 | 1/3 | 1.45 | 0.05 | ◎ |
| 11 | 1/10 | 1/7 | 1.43 | 0.05 | ◎ |
| 12 | 1/10 | 5/1 | 1.50 | 0.10 | ○ |
| 13 * | 1/10 | 1/10 | 1.02 | 0.10 | Δ |
| 14 * | 1/7 | 1/7 | 1.30 | 0.15 | Δ |
| 15 * | 1/10 | 10/1 | 1.45 | 0.20 | Δ |

As obvious from Table 11, the photosensitive members 9, 10, 11, 12 within the scope of the present invention could give an excellent image quality, in particular the photosensitive members 10, 11 did not show the background smearing at 11. However, the photosensitive members 7, 8, 13, 14, 15 showed a slightly reduced concentration of image and a slight background smearing since the ratio of C and Si contained in the carrier transport layer and/or the carrier barrier layer is outside of the scope according to the present invention.

EXAMPLE 11

In the present EXAMPLE the flow rate and the ratio of $SiH_4$ gas and $C_2H_2$ gas in the formation of the carrier transport layer (5) in EXAMPLE 1 were changed and also the tanks filled with $O_2$ gas, $N_2O$ gas, $NO_2$ gas, $N_2$ gas and the like in addition to NO gas were prepared followed by changing the flow rates and the ratio of these gases and $C_2H_2$ gas to form the carrier transport layer having various kinds of ratio of C and Si and the carrier barrier layer containing at least one of oxygen and nitrogen at various kinds of ratio, and the carrier generation layer (3) and the surface protection layer (4) were formed under the same conditions as in EXAMPLE 1 to produce 12 kinds of photosensitive member (16 to 27).

An image was obtained from these photosensitive members in the same manner as in EXAMPLE 10 and the concentration of these resulting images or the concentration of the background smearing when produced were measured by means of the image concentration meter with the result as shown in Table 12.

In addition, the photosensitive members marked with * are outside of the scope of the present invention.

TABLE 12

| Photo-sensitive member | Rate of C and Si contained in the carrier transport layer | Carrier barrier layer (atomic %) Oxygen content | Nitrogen content | Total content | Concen-tration of image | Concen-tration of back-ground smearing | Evaluation of image quality |
|---|---|---|---|---|---|---|---|
| 16 * | 1/150 | 5 | — | 5 | 0.92 | 0.05 | Δ |
| 17 * | 1/80 | 0.05 | — | 0.05 | 0.91 | 0.05 | Δ |
| 18 | 1/80 | 25 | — | 25 | 1.33 | 0.10 | ○ |
| 19 | 1/80 | 15 | 5 | 20 | 1.35 | 0.09 | ○ |
| 20 | 1/30 | 4 | 1 | 5 | 1.48 | 0.05 | ◎ |
| 21 | 1/30 | — | 8 | 8 | 1.37 | 0.08 | ◎ |
| 22 | 1/10 | 5 | — | 5 | 1.45 | 0.05 | ◎ |
| 23 | 1/10 | — | 0.3 | 0.3 | 1.30 | 0.05 | ○ |
| 24 | 1/10 | — | 25 | 25 | 1.40 | 0.10 | ○ |
| 25 * | 1/10 | 0.05 | — | 0.05 | 1.02 | 0.09 | Δ |
| 26 * | 1/10 | 35 | 15 | 50 | 1.50 | 0.20 | Δ |
| 27 * | 1/7 | 0.2 | — | 0.2 | 1.30 | 0.18 | Δ |

As obvious from Table 12, the photosensitive members 18, 19, 20, 21, 22, 23, 24 within the scope of the present invention could give an excellent image quality, in particular the photosensitive members 20, 21, 22 did not show the background smearing at all. However, the photosensitive members 16, 17, 25, 26, 27 showed the slightly reduced concentration of image and the slight background smearing since the carrier transport layer or the carrier barrier layer has the atomic ratio outside of the scope of the present invention.

EXAMPLE 12

The flow rates and ratio of $SiH_4$ gas and $C_2H_2$ gas in the formation of the carrier transport layer (5) and the carrier generation layer (3) in EXAMPLE 2 were changed to form the films having various kinds of composition and the surface protection layer (4) was formed under the same conditions as in EXAMPLE 2 to produce 9 kinds of photosensitive member (28 to 36).

These photosensitive members were used to obtain an image in the same manner as in EXAMPLE 10 and the concentration of the resulting image or background smearing was measured by means of the image concentration meter with the results shown in Table 13.

In addition, the photosensitive members marked with * are outside of the scope of the present invention.

TABLE 13

| Photo-sensitive member | Ratio of C and Si contained in the carrier transport layer | Ratio of C and Si contained in the carrier generation layer | Concen-tration of image | Concen-tration of back-ground smearing | Evaluation of image quality |
|---|---|---|---|---|---|
| 28 * | 1/150 | 1/9 | 0.97 | 0.05 | Δ |
| 29 * | 1/80 | 1/150 | 0.95 | 0.05 | Δ |
| 30 | 1/80 | 1/1 | 1.40 | 0.11 | ○ |
| 31 | 1/30 | 1/4 | 1.50 | 0.06 | ◎ |
| 32 | 1/10 | 1/15 | 1.48 | 0.05 | ◎ |
| 33 | 1/10 | 2/1 | 1.50 | 0.12 | ○ |
| 34 * | 1/10 | 1/150 | 1.10 | 0.10 | Δ |
| 35 * | 1/10 | 12/1 | 1.50 | 0.25 | Δ |
| 36 * | 1/7 | 1/30 | 1.35 | 0.20 | Δ |

As obvious from Table 13, the photosensitive members 30, 31, 32, 33 within the scope of the present invention gave an excellent image quality, in particular the photosensitive members 31, 32 did not show the background smearing at all. However, the photosensitive members 28, 29, 34, 35, 36 gave a slightly reduced concentration of image and showed a slight background smearing since the ratios of C and Si contained in the carrier transport layer and/or the carrier generation layer were outside of the scope of the present invention.

EXAMPLE 13

The flow rates and ratio of $SiH_4$ gas and $C_2H_2$ gas in the formation of the carrier transport layer (5) and the carrier generation layer (3) in EXAMPLE 3 were changed to form the films having various kinds of composition, whereby producing 10 kinds of photosensitive member (37 to 46).

These photosensitive members were used to obtain an image in the same manner as in EXAMPLE 10 and the concentration of the resulting image or background smearing was measured by means of the image concentration meter with the results shown in Table 14.

In addition, the photosensitive members marked with * are outside of the scope of the present invention.

TABLE 14

| Photo-sensitive member | Ratio of C and Si contained in the carrier transport layer | Ratio of C and Si contained in the carrier generation layer | Ratio of C and Si contained in the carrier barrier layer | Concen-tration of image | Concen-tration of back-ground smearing | Evalu-ation of image quality |
|---|---|---|---|---|---|---|
| 37 * | 1/150 | 1/4 | 1/3 | 1.05 | 0.06 | Δ |
| 38 * | 1/80 | 1/4 | 10/1 | 1.10 | 0.09 | Δ |
| 39 * | 1/80 | 2/1 | 1/10 | 1.35 | 0.20 | Δ |
| 40 | 1/80 | 2/1 | 1/1 | 1.42 | 0.09 | ○ |
| 41 | 1/80 | 1/30 | 1/7 | 1.40 | 0.07 | ○ |
| 42 | 1/30 | 1/4 | 1/3 | 1.50 | 0.05 | ◎ |
| 43 | 1/10 | 2/1 | 1/1 | 1.52 | 0.12 | ○ |
| 44 | 1/10 | 1/10 | 5/1 | 1.48 | 0.13 | ○ |
| 45 * | 1/10 | 2/1 | 1/10 | 1.46 | 0.25 | Δ |
| 46 * | 1/7 | 1/4 | 1/3 | 1.38 | 0.23 | Δ |

As obvious from Table 14, the photosensitive members 40, 41, 42, 43 within the scope of the present invention gave an excellent image quality, in particular the photosensitive member 42 did not show the background smearing at all. However, the photosensitive members 37, 38, 39, 45, 46 showed a slightly reduced concentration of image or a slight background smearing since the ratio of C and Si contained in the carrier transport layer and/or the carrier barrier layer were outside of the scope of the present invention.

EXAMPLE 14

The flow rates of $SiH_4$ gas and $C_2H_2$ gas in the formation of the carrier transport layer (5) in EXAMPLE 4 and the flow rates of $SiH_4$ gas and $GeH_4$ gas in the formation of the carrier generation layer (3) in EXAMPLE 4 were changed to form the carrier transport layer and the carrier generation layer having various kinds of atomic ratio shown in Table 15, and the surface protection layer (4) was formed under the same conditions as in EXAMPLE 4 to produce 9 kinds of photosensitive member (47 to 55).

These photosensitive members were mounted on the semiconductor laser beam printer (a copying speed of 40 pieces/min) under the severe conditions that the background smearing is apt to be produced most to obtain an image and the concentration of image or background smearing was measured by means of the image concentration meter with the results shown in Table 15. In addition, the photosensitive members marked with * are outside of the scope of the present invention.

TABLE 15

| Photo-sensitive member | Ratio of C and Si contained in the carrier transport layer | Ratio of Ge and Si contained in the carrier generation layer | Concen-tration of image | Concen-tration of background smearing | Evalucation of image quality |
|---|---|---|---|---|---|
| 47 * | 1/150 | 1/20 | 0.95 | 0.05 | Δ |
| 48 * | 1/80 | 1/150 | 0.90 | 0.05 | Δ |
| 49 | 1/80 | 1/3 | 1.25 | 0.09 | ○ |
| 50 | 1/30 | 1/10 | 1.43 | 0.05 | ◎ |
| 51 | 1/10 | 1/20 | 1.38 | 0.06 | ◎ |
| 52 | 1/10 | 1/80 | 1.45 | 0.10 | ○ |
| 53 * | 1/10 | 1/150 | 1.00 | 0.09 | Δ |
| 54 * | 1/10 | 1/1 | 1.45 | 0.18 | Δ |
| 55 * | 1/7 | 1/80 | 1.35 | 0.18 | Δ |

As obvious from Table 15, the photosensitive members 49, 50, 51, 52 within the scope of the present invention gave an excellent image quality, in particular the photosensitive members 50, 51 did not show a background smearing at all. However, the photosensitive members 47, 48, 53, 54, 55 showed a slightly reduced concentration of image and a slight background smearing since the carrier transport layer or the carrier generation layer has an atomic ratio outside of the scope of the present invention.

EXAMPLE 15

The flow rates of $SiH_4$ gas and $C_2H_2$ gas in the formation of the carrier transport layer (5) and the carrier barrier layer (2) in EXAMPLE 5 and the flow rates of $SiH_4$ gas and $GeH_4$ gas in the formation of the carrier generation layer (3) in EXAMPLE 5 were changed to form the carrier transport layer and the carrier generation layer having various kinds of atomic ratio shown in Table 16 and the surface protection layer (4) was formed under the same conditions as in EXAMPLE 5 to produce 10 kinds of photosensitive member (56 to 65).

These photosensitive members were used to obtain an image in the same manner as in EXAMPLE 14 and the concentration of the resulting image or background smearing was measured by means of the image concentration meter with the results shown in Table 16.

In addition, the photosensitive members marked with * are outside of the scope of the present invention.

TABLE 16

| Photo-sensitive member | Ratio of C and Si contained in the carrier transport layer | Ratio of Ge and Si contained in the carrier generation layer | Ratio of C and Si contained in the carrier barrier layer | Concen-tration of image | Concen-tration of back-ground smearing | Evaluation of image quality |
|---|---|---|---|---|---|---|
| 56 * | 1/150 | 1/10 | 1/3 | 1.10 | 0.05 | Δ |
| 57 * | 1/80 | 1/1 | 1/3 | 1.00 | 0.07 | Δ |
| 58 * | 1/80 | 1/10 | 1/10 | 0.98 | 0.05 | Δ |
| 59 | 1/80 | 1/3 | 1/3 | 1.35 | 0.10 | ○ |
| 60 | 1/80 | 1/80 | 5/1 | 1.37 | 0.11 | ○ |
| 61 | 1/30 | 1/10 | 1/3 | 1.50 | 0.06 | ◎ |
| 62 | 1/10 | 1/3 | 1/7 | 1.34 | 0.06 | ○ |
| 63 * | 1/10 | 1/3 | 1/10 | 1.05 | 0.08 | Δ |
| 64 * | 1/10 | 1/150 | 1/3 | 1.00 | 0.05 | Δ |
| 65 * | 1/7 | 1/10 | 1/3 | 1.10 | 0.09 | Δ |

As obvious from Table 16, the photosensitive members 59, 60, 61, 62 within the scope of the present invention gave an excellent image quality, in particular the photosensitive member 61 did not show a background smearing at all. However, the photosensitive members 56, 57, 58, 63, 63, 65 showed a slightly reduced concentration of image and a slight background smearing since the carrier barrier layer, the carrier transport layer or the carrier generation layer has an atomic ratio outside of the scope of the present invention.

EXAMPLE 16

The flow rates of $SiH_4$ gas and $C_2H_2$ gas in the formation of the carrier transport layer (5) in EXAMPLE 6 and the flow rates of $SiH_4$ gas, $C_2H_2$ gas and $GeH_4$ gas in the formation of the carrier generation layer (3) in EXAMPLE 6 were changed to form the carrier transport layer (5) and the carrier generation layer (3) having various kinds of atomic ratio and the surface protection layer (4) was formed under the same conditions as in EXAMPLE 6 to produce 10 kinds of photosensitive member (66 to 75).

These photosensitive members were used to obtain an image in the same manner as in EXAMPLE 14 and the concentration of the resulting image or background smearing was measured by means of the image concentration meter with the results shown in Table 17.

In addition, the photosensitive members marked with * are outside of the scope of the present invention.

As obvious from Table 17, the photosensitive members 69, 70, 71, 72 within the scope of the present invention gave an excellent image quality, in particular the photosensitive member 71 did not show a background smearing at all. However, the photosensitive members 66, 67, 68, 73, 74, 75 showed a slightly reduced concentration of image and a slight background smearing since the carrier transport layer or the carrier generation layer has an atomic ratio outside the scope of the present invention.

EXAMPLE 17

The flow rates of $SiH_4$ gas and $C_2H_2$ gas in the formation of the carrier barrier layer (2) and the carrier transport layer (5) in EXAMPLE 7 and the flow rates of $SiH_4$ gas, $C_2H_2$ gas and $GeH_4$ gas in the formation of the carrier generation layer (3) in EXAMPLE 7 were changed to form the carrier barrier layer (2), the carrier transport layer (5) and the carrier generation layer (3) having various kinds of atomic ratio and the surface protection layer (4) was formed under the conditions as in EXAMPLE 7 to produce 13 kinds of photosensitive member (76 to 88).

These photosensitive members were used to obtain an image in the same manner as in EXAMPLE 14 and the concentration of the resulting image or background smearing was measured by means of the image concentration meter with the results shown in Table 18.

In addition, the photosensitive members marked with * are outside of the scope of the present invention.

TABLE 17

| Photo-sensitive member | Ratio of C and Si contained in the carrier transport layer | Ratio of C and Si contained in the carrier generation layer | Ratio of Ge and Si contained in the carrier generation layer | Concen-tration of image | Concen-tration of back-ground smearing | Evaluation of image quality |
|---|---|---|---|---|---|---|
| 66 * | 1/150 | 1/10 | 1/10 | 1.00 | 0.07 | Δ |
| 67 * | 1/80 | 1/10 | 1/1 | 1.15 | 0.10 | Δ |
| 68 * | 1/80 | 2/1 | 1/10 | 1.20 | 0.18 | Δ |
| 69 | 1/80 | 1/2 | 1/3 | 1.40 | 0.11 | ○ |
| 70 | 1/80 | 1/80 | 1/80 | 1.38 | 0.06 | ○ |
| 71 | 1/30 | 1/10 | 1/10 | 1.45 | 0.06 | ◎ |
| 72 | 1/10 | 1/2 | 1/3 | 1.50 | 0.10 | ○ |
| 73 * | 1/10 | 1/150 | 1/3 | 1.30 | 0.20 | Δ |
| 74 * | 1/10 | 1/2 | 1/150 | 1.43 | 0.25 | Δ |
| 75 * | 1/7 | 1/10 | 1/10 | 1.35 | 0.20 | Δ |

TABLE 18

| Photosensitive member | Ratio of C and Si contained in the carrier transport layer | Carrier generation layer: Ratio of C and Si | Carrier generation layer: Ratio of Ge and Si | Ratio of C and Si contained in the carrier barrier layer | Concentration of image | Concentration of background smearing | Evaluation of image quality |
|---|---|---|---|---|---|---|---|
| 76 * | 1/150 | 1/10 | 1/10 | 1/2 | 1.10 | 0.08 | Δ |
| 77 * | 1/80 | 1/10 | 1/1 | 1/2 | 1.20 | 0.12 | Δ |
| 78 * | 1/80 | 2/1 | 1/10 | 1/2 | 1.25 | 0.19 | Δ |
| 79 | 1/80 | 1/2 | 1/3 | 1/2 | 1.45 | 0.11 | ○ |
| 80 | 1/80 | 1/80 | 1/80 | 1/2 | 1.42 | 0.07 | ○ |
| 81 | 1/30 | 1/10 | 1/10 | 1/2 | 1.52 | 0.06 | ◎ |
| 82 | 1/10 | 1/2 | 1/3 | 1/2 | 1.45 | 0.11 | ○ |
| 83 * | 1/10 | 1/150 | 1/3 | 1/2 | 1.35 | 0.22 | Δ |
| 84 * | 1/10 | 1/2 | 1/150 | 5/1 | 1.48 | 0.20 | Δ |
| 85 * | 1/7 | 1/10 | 1/10 | 1/2 | 1.40 | 0.23 | Δ |
| 86 | 1/30 | 1/10 | 1/10 | 1/5 | 1.50 | 0.07 | ◎ |
| 87 * | 1/30 | 1/10 | 1/10 | 10/1 | 1.60 | 0.25 | Δ |
| 88 * | 1/30 | 1/10 | 1/10 | 1/10 | 1.15 | 0.06 | Δ |

As obvious from Table 18, the photosensitive members 79, 80, 81, 82 within the scope of the present invention gave an excellent image quality, in particular the photosensitive member 81 did not show a background smearing at all. However, the photosensitive members 76, 77, 78, 83, 84, 85 showed a slightly reduced concentration of image and a slight background smearing since the carrier transport layer or the carrier generation layer has an atomic ratio outside of the scope of the present invention.

EXAMPLE 18

In this EXAMPLE, an a-SiGeC film having a single composition in the direction of layer thickness was formed and the spectrosensitive characteristics thereof were measured.

That is to say, a multi-angular flat plate having a size of 3×3 cm formed a aluminum was prepared and a part of the circumferential surface of the cylindrical substrate (33) formed of aluminum was cut away. The flat plate was disposed in the resulting cut-away portion and $SiH_4$ gas was emitted from the tank (9), $GeH_4$ gas from the tank (11), $C_2H_2$ gas from the tank (10) and $H_2$ gas from the tank (13) at the flow rates shown in Table 19 under the manufacturing conditions set in the appointed manner to form an a-SiC film or an a-SiGeC film having a thickness of 5 μm on the above described flat plate by the glow discharge decomposition method.

TABLE 19

| Sample | Flow rate of gas (sccm): $SiH_4$ | $C_2H_2$ | $GeH_4$ | $H_2$ | Pressure (Torr) | High-frequency electric power (W) | Substrate temperature (°C.) |
|---|---|---|---|---|---|---|---|
| A | 100 | 10 | — | — | 0.45 | 150 | 300 |
| B | 100 | 10 | 5 | 300 | 0.45 | 150 | 300 |
| C | 100 | 10 | 10 | 300 | 0.45 | 150 | 300 |

Figure 7:
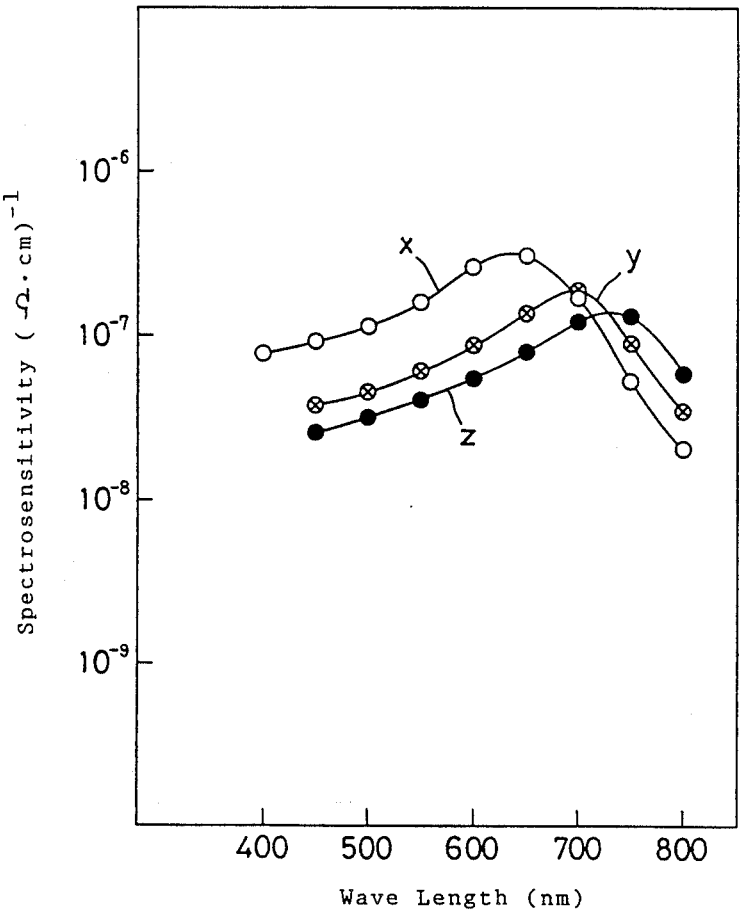
FIG. 7 is a graph showing a spectrosensitive curve of an amorphous silicon germanium carbide layer.

The spectrosensitive characteristics of the resulting sample a (a-SiC film) and B (a-SiGeC film) were measured with the results shown in FIG. 7. Referring to FIG. 7, the mark ○, ⊗ and ● shows a plot of spectrosensitivity for the sample A, B and C, respectively, and x, y and z shows the respective spectrosensitive curve. The measured value of this spectrosensitivity shows a photoconductance when a light having an equal energy is incident upon the sample at each wavelength by the use of planar type electrode.

As obvious from these results, a peak of spectrosensitivity is shifted toward a longer wavelength side with an increase of Ge-content to obtain an electrophotographic sensitive member suitable for the semiconductor laser beam printer.

EFFECTS OF THE INVENTION

As above described, with an electrophotographic sensitive member according to the present invention, the residual potential could be reduced and the potential smearing could be prevented from being produced by setting the atomic ratio of C and Si within the appointed range in the production of the separated function type photosensitive member comprising an a-SiC carrier transport layer. And, in the case where this photosensitive member is mounted on the high-speed copying machine, which is apt to produce the background smearing most, the effect is notable, whereby the electrophotographic sensitive member according to the present invention can be provided as a photosensitive member suitable for the high-speed copying machine.

In addition, according to the electrophotographic sensitive member of the present invention, the surface potential can be still more increased by forming an a-SiC carrier barrier layer and/or a carrier generation layer having the appointed atomic ratio, whereby not only the concentration of image can be heightened but also the background smearing can be effectively prevented from being produced. As a result, as above described, a photosensitive member suitable for the high-speed copying machine can be provided.

Furthermore, according to the electrophotographic sensitive member of the present invention, the surface potential can be still more increased by forming an a-Si carrier barrier layer comprising oxygen or nitrogen, whereby not only the concentration of image can be heightened but also the background smearing can be effectively prevented from being produced. As a result, as above described, a photosensitive member suitable for the high-speed copying machine can be provided.

And, according to the electrophotographic sensitive member of the present invention, in the case where the a-Si carrier barrier layer comprising oxygen or nitrogen is formed on the substrate formed of aluminum, the adhesion of the a-Si layer to the substrate is increased to maintain the initial characteristics of the photosensitive member, whereby providing an electrophotographic sensitive member showing the fidelity for a long time.

In addition, according to the electrophotographic sensitive member of the present invention, the photosensitivity in the vicinity of the near-infrared range can be heightened to provide an electrophotographic sensitive member suitable for the semiconductor laser beam printer capable of conducting the high-speed copying and high-speed printing.

Besides, according to the electrophotographic sensitive member of the present invention, the a-SiGeC layer can be used as the carrier generation layer for lights having longer wavelengths to provide an electrophotographic sensitive member suitable for the semiconductor laser beam printer. Furthermore, according to this photosensitive member, since the incident ray does not arrive at the substrate, the interference fringe pattern can be prevented from being produced on the image and it becomes unnecessary to roughen the substrate surface, whereby increasing the surface roughness of the substrate surface. As a result, an inexpensive electrophotographic sensitive member can be provided.

We claim:

1. An electrophotographic sensitive member comprising: a substrate;

a carrier transport layer having a thickness of between about 1 and about 50 μm, said carrier transport layer being formed of an amorphous silicon carbide with an atomic ratio of carbon to silicon set at 1:100 to 1:9; and a carrier generation layer formed of an amorphous silicon carbide with an atomic ratio of carbon to silicon set at 1:100 to 9:1, wherein said carrier transport layer and said carrier generation layer comprises a dopant selected from the group consisting of elements of Group Va of the Periodic Table and elements of Group IIIa of the Periodic Table and mixtures thereof, said dopant being present in said carrier transport layer in an amount greater than in said carrier generation layer; and wherein hydrogen or a mixture thereof with halogen is incorporated at a ratio of about 5 to about 50 atomic percent for terminating dangling bonds.

2. An electrophotographic sensitive member according to claim 1, within the atomic ratio of carbon to silicon in said carrier transport layer is between about 1:20 and 1:9.

3. An electrophotographic sensitive member according to claim 1, wherein the atomic ratio of carbon to silicon in said carrier generation layer is between about 1:20 to 1:1.

4. An electrophotographic sensitive member according to claim 1, further comprising a barrier layer, said barrier layer having a composition selected from the group consisting of organic materials, silicon dioxide, silicon oxide, aluminum oxide, silicon nitride, amorphous silicon carbide having a carbon to silicon ratio set to 1:9 to 9:1 and amorphous silicon containing at least one of oxygen and nitrogen in a quantity of 0.1 to 30 atomic percent.

5. An electrophotographic sensitive member according to claim 4, wherein said barrier layer has a thickness between about 0.2 and about 5.0 μm.

6. An electrophotographic sensitive member according to claim 4, comprising amorphous silicon carbide with a carbon to silicon ratio set at 2:8 to 8:2.

7. An electrophotographic sensitive member comprising:

a substrate;

a carrier transport layer having a thickness of between about 1 and about 50 μm, said carrier transport layer being formed of an amorphous silicon carbide with an atomic ratio of carbon to silicon set at 1:100 to 1:10; and a carrier generation layer formed of an amorphous silicon germanium with an atomic ratio of silicon to germanium set at 2:1 to 100:1, or of an amorphous silicon germanium carbide with an atomic ratio of silicon to germanium of 2:1 to 100:1 and an atomic ratio of silicon to carbon of 1:1 to 100:1;

wherein hydrogen or a mixture thereof with halogen is incorporated at a ratio of about 5 to about 50 atomic percent for terminating dangling bonds.

8. An electrophotographic sensitive member according to claim 7, wherein said carrier generation layer comprises amorphous silicon germanium.

9. An electrophotographic sensitive member according to claim 8, wherein the ratio of silicon to germanium is between about 8:1 and 30:1.

10. An electrophotographic sensitive member according to claim 7, wherein said carrier generation layer comprises amorphous silicon germanium carbide.

11. An electrophotographic sensitive member according to claim 10, wherein the silicon to germanium ratio is between about 3:1 to 30:1.

12. An electrophotographic sensitive member according to claim 10, wherein the silicon to carbon ratio is between about 3:1 and 100:1.

13. An electrophotographic sensitive member according to claim 7, further comprising a barrier layer superimposed above said substrate, said barrier layer having a composition selected from the group consisting of organic materials, silicon dioxide, silicon oxide, aluminum oxide, silicon nitride, amorphous silicon carbide having a carbon to silicon ratio set at 1:9 to 9:1 and amorphous silicon containing at least one of oxygen and nitrogen in a quantity of 0.1 to 30 atomic percent.

14. An electrophotographic sensitive member according to claim 13, wherein said barrier layer has a thickness between about 0.2 and about 5.0 μm.

15. An electrophotographic sensitive member according to claim 13, comprising amorphous silicon carbide with a carbon to silicon ratio set at 2:8 to 8:2.

* * * * *